US011849288B2

(12) United States Patent
Piechowiak et al.

(10) Patent No.: US 11,849,288 B2
(45) Date of Patent: Dec. 19, 2023

(54) USABILITY AND SATISFACTION OF A HEARING AID

(71) Applicant: GN Hearing A/S, Ballerup (DK)

(72) Inventors: Tobias Piechowiak, Hedehusene (DK); Christoffer Dyssegard, Ballerup (DK); Anthea Bott, Copenhagen (DK); Lionel Plato Kuhlmann, Virum (DK)

(73) Assignee: GN HEARING A/S, Ballerup (DK)

( * ) Notice: Subject to any disclaimer, the term of this patent is extended or adjusted under 35 U.S.C. 154(b) by 182 days.

(21) Appl. No.: 17/542,020

(22) Filed: Dec. 3, 2021

(65) Prior Publication Data

US 2022/0217486 A1 Jul. 7, 2022

(30) Foreign Application Priority Data

Jan. 4, 2021 (DK) ..... 2021 70001

(51) Int. Cl.
*H04R 25/00* (2006.01)

(52) U.S. Cl.
CPC ..... *H04R 25/70* (2013.01); *H04R 25/507* (2013.01)

(58) Field of Classification Search
CPC ..... H04R 25/305; H04R 25/30; H04R 25/39; H04R 25/50; H04R 25/505; H04R 25/507; H04R 2225/81; G06Q 30/016
See application file for complete search history.

(56) References Cited

U.S. PATENT DOCUMENTS 9,084,066 B2 * 7/2015 De Vries ..... H04R 25/70
9,519,867 B1 * 12/2016 Reeves ..... G06Q 30/00
10,477,325 B2 * 11/2019 Andersson ..... A61N 1/36038
11,343,618 B2 * 5/2022 Fichtl ..... H04R 25/70
11,375,325 B2 * 6/2022 Froehlich ..... H04R 25/507
2010/0195839 A1 8/2010 Barthel et al.
2012/0095528 A1 4/2012 Miller, III et al.
2013/0177188 A1 * 7/2013 Apfel ..... A61B 5/0022 381/315
2018/0213339 A1 * 7/2018 Shah ..... H04R 25/558
2018/0268347 A1 * 9/2018 Benedetti ..... G06Q 30/0631
2019/0069098 A1 2/2019 Walsh et al.
2019/0069107 A1 2/2019 Gandhi et al.
2020/0045484 A1 2/2020 Gandhi et al.
2020/0112802 A1 4/2020 Andersson
2020/0349582 A1 * 11/2020 Savir ..... G06N 20/10
2022/0114607 A1 * 4/2022 Wei ..... G06Q 30/0201

FOREIGN PATENT DOCUMENTS

WO WO 00/07478 2/2000
WO WO 2007/042043 4/2007
WO WO 2008/084116 7/2008
WO WO 2019/040895 2/2019
WO WO 2019/120521 6/2019
WO WO-2020217494 A1 * 10/2020

OTHER PUBLICATIONS

1st technical examination report dated Jul. 2, 2021 issued for Danish patent application No. PA 2021 70001.
Extended European Search Report for EP Patent Appln. No. 22150041.6 dated Jun. 3, 2022.

* cited by examiner

*Primary Examiner* — Ryan Robinson
(74) *Attorney, Agent, or Firm* — Vista IP Law Group, LLP

(57) ABSTRACT

The present disclosure relates to a method of improving usability of, and satisfaction with, a hearing aid. Further provided is a system comprising a hearing aid, wherein the system is configured to perform the method.

21 Claims, 5 Drawing Sheets

USABILITY AND SATISFACTION OF A HEARING AID

RELATED APPLICATION DATA

This application claims priority to, and the benefit of, Danish Patent Application No. PA 2021 70001 filed on Jan. 4, 2021. The entire disclosure of the above application is expressly incorporated by reference herein.

FIELD

The present disclosure relates to improving the experience of wearing a hearing aid. Provided is a method of improving usability of, and satisfaction with, a hearing aid. Further provided is a data processing system for analysing satisfaction with a hearing aid according to the method, and a hearing aid comprising at least part of the data processing system.

BACKGROUND

Using a hearing aid can be uncomfortable or irritating due to e.g. the functionality and/or feel of the hearing aid. For example, the change in auditory inputs due to the compensation algorithms can cause discomfort. The result is a lack of satisfaction, which may ultimately cause a user to return the hearing aid to the manufacturer.

A hearing aid return is an unpleasant aspect for the hearing impaired, hearing care professionals, and hearing instrument manufacturers alike. For the user, time has been spent selecting the hearing aid, having one or more fittings with a hearing care professional and wearing the hearing aid while not being entirely satisfied. The hearing care professional has spent time helping the user and fitting the hearing aid. Further, dealing with a return uses time that could have been spent on other users. For the manufacturer, time and resources spent to replace hearing instrument components will often be mirrored by higher initial cost of all hearing instruments.

In some cases, the return of the hearing aid was unnecessary as adjustments could have improved the user's experience. However, the user may have neglected to seek available help to address the problem that was experienced with the hearing aid. Some users will instead often attempt to resolve or work around the problem they are experiencing.

SUMMARY

It is an object of some embodiments to solve or mitigate, alleviate, or eliminate at least some of the above or other drawbacks.

In a first aspect is provided a method of improving usability of and satisfaction with a hearing aid. The method comprises the steps of:

- obtaining data from a hearing aid belonging to a user,
- determining, at least in part on the basis of the obtained data, a prediction score indicating the likelihood of the user being dissatisfied with the hearing aid, and
- executing a response measure if the prediction score indicates that the user is dissatisfied, wherein the response measure comprises adjusting the hearing aid functionality, or arranging human support, or a combination thereof.

A hearing aid, which collect data from the user, will often use some of the data e.g. to adapt to the user, or it may transmit the data to a processing unit outside the hearing aid. As part of the function of a hearing aid, the hearing aid comprises a compensation algorithm, which acts to compensate for the users hearing loss.

The prediction score is an indicator of whether it is likely that the user is satisfied or dissatisfied with their hearing aid and may be the result of a predictive model, which may be built using past data.

The response measure is an action that is taken in response to a prediction score that indicates user dissatisfaction, for example, a prediction score that is greater than a predetermined value. Executing a response measure may mean arranging for a response measure to be implemented.

The obtained data, on which the prediction score is determined at least in part, may comprise at least one of:

- use-time,
- number of pre-set/program changes,
- number of power downs,
- number of re-boots,
- number of battery charges,
- number of sound environment changes,
- pattern of sound environment changes,
- time spent in a type of sound environment,
- GPS location,
- temperature,
- pulse, or
- oxidation saturation.

The use-time is how much time the hearing aid is being used within a predetermined period of time, such as number of hours during a day. A user, who is dissatisfied with a hearing aid, may tend to use the hearing aid more or less.

The number of pre-set/program changes are changes between pre-sets/programs within a predetermined period of time. A user, who is dissatisfied with a hearing aid, may change the programs several times to try and find a setting that will make them more comfortable, or they may change the programs less often.

The number of power downs is the number of times the hearing aid is turned off within a predetermined period of time, such as within a day. A user who is dissatisfied with a hearing aid may turn off their hearing aid more often or less.

The number of re-boots is the number of times the hearing aid is turned off and back on shortly after within a predetermined period of time, such as within a day. A user who is dissatisfied with a hearing aid may try to reset the hearing aid more often or less.

The number of battery charges is the number of times a rechargeable battery in the hearing aid is re-charged, either partially or fully, within a predetermined period of time.

If the hearing aid can detect the sound environment, such as detect whether it is a noisy or quiet environment, such as whether it is an indoors or outdoors environment, such as whether it is a cocktail party type of sound environment or whether it is a quiet conversation type of sound environment, the type and number of sound environment changes during a predetermined period of time may be recorded by the hearing aid. A user, who is dissatisfied with a hearing aid, may try to change sound environment often due to discomfort or poor functionality experienced with the hearing aid, or the user may change often to a different type of noise environment, such as a less noisy type of sound environment. The user, who is dissatisfied with a hearing aid, may also spend more time in a type of sound environment, such as more time in a type of sound environment that is considered quiet.

The GPS location may, for example, indicate whether the user is using the hearing aid in many different locations or whether the user is using the hearing aid in few locations.

If the hearing aid is equipped with one or more sensors, such as sensors for health monitoring, enabling it to measure one or more physical properties e.g. temperature, pulse, oxidation saturation, these sensor data may also have predictive value for the user satisfaction.

The prediction score may be determined at least partly based on data logged prior to hearing aid returns compared to data logged from non-returns. That is, data obtained during a period where users were dissatisfied is available for comparison to data from users, who did not return their hearing aid. This allows for a comparison to be made between the data from the users, who did not return their hearing aid, and the users, who did, in order to determine parameters, which are useful in predicting the satisfaction of a hearing aid user. Thus, data logged prior to hearing aid returns and non-returns may be used in building a model forming part of the determination of a prediction score. A user that ultimately returns the hearing aid was likely dissatisfied with the hearing aid and their behaviour before the return indicative of this dissatisfaction. Therefore, one or more of the user's actions or sensory data, which are recorded by the hearing aid, may reflect this dissatisfaction.

Patterns in data may be distinguished by an artificial intelligence algorithm such as a machine learning system. A machine learning model such as a neural network that is sensitive to sequence information, e.g. 1D ConvNets, can be trained to distinguish between users, who return their hearing aids to those who do not by learning the trends in the data parameters of those who return their hearing aids. Thus, the step of determining a prediction score may be at least partly performed using machine learning and/or artificial intelligence. For example, the step of determining a prediction score may be at least partly based on a model made using machine learning.

Additionally, or alternatively, the prediction score may be further determined at least in part on the basis of user-specific data. Examples of user-specific data are the type and/or model of the hearing aid, such as e.g. In-the-ear (ITE), Behind-the-ear (BTE), Receiver-in-ear (RIE), Microphone-and-receiver-in-ear (MaRIE), and demographics, such as e.g. age, gender, socioeconomics, hearing loss profile, user feedback rating provided, etc. Other examples of user-specific data are number of contacts to a hearing care professional, and use-time of a linked app, i.e. an app linked, for example via Bluetooth or Wi-Fi, to the user or to the hearing aid.

Some or all of the user-specific data may be obtained remotely, such as from e.g. one or more databases or external devices. Such user-specific data obtained remotely could link the information to the hearing aid ID and thereby link it to data obtained from the hearing aid.

A user feedback rating, i.e. a rating provided by the user based on use of the hearing aid, could, for example, be a rating given by the user after a remote fine tuning of the user's hearing aid has been performed. The user feedback rating could be given on a scale, for example on a scale of 1-3. The user feedback rating may be provided by the user via e.g. an app or a website.

After determining a prediction score indicative of user dissatisfaction, a response measure is initiated, wherein the response measure comprises adjusting, e.g. improving or adapting, the hearing aid functionality, or arranging for human support. The response measure may comprise one or more actions.

Adjustments to the hearing aid functionality could, for example, be categorized in three categories: adjusting fitting parameters, firmware update, and switching operation modes. Adjusting fitting parameters, also known as algorithm parameters, is related to individual hearing loss and is done either with a Hearing Care Professional during fitting of the hearing aid or later as a fine-tuning after the initial fitting. Firmware is software that provides the general operational functions (hearing compensation functions, wireless communication, power control, etc.) for the hearing aid. Switching operation modes is done either manually by the user or automatically, for example according to acoustic environments or EEG sensor etc. The operation modes are usually determined by the firmware and are customized during fitting. However, apart from switching among different modes, the parameters for hearing compensation for an individual is customarily not changed during the hearing aid operation, i.e. while the hearing aid is in normal use.

For example, if the response measure comprises adjusting the hearing aid functionality, the measure may comprise one or more of:

- reinstalling software on the hearing aid, such as rewriting the firmware,
- updating software on the hearing aid,
- changing one or more algorithm parameters, i.e. compensation algorithm parameters,
- performing remote automatic fine-tuning of the hearing aid, and/or
- updating one or more pre-sets/programs on the hearing aid.

Remote automatic fine-tuning comprises sending a data package containing new settings to the hearing aid, for example adjusting the gain curves or number of pre-sets/programs.

A program on the hearing aid is a predefined setting that a user can switch on or off, for example a setting optimized for speech in a restaurant type of sound environment. Programs are also known as pre-sets. Usually, a hearing aid will have a collection of pre-sets/programs.

Whereas, if the response measure comprises arranging for human support, the measure may comprise one or more of:

- notifying the hearing aid user,
- notifying a hearing care professional, and/or
- notifying a customer service employee.

When the response measure comprises notifying the hearing aid user, the notification may be executed directly via the hearing aid(s) and/or via one or more intermedia devices, which provide services consisting of one or any of a combination of an acoustic signal, or visual signal e.g. via an app/software, and/or via text or email message.

If the response measure comprises notifying a hearing care professional or a customer service employee, the notification may be executed via at least one intermedia device, which provides services consisting of one or any of a combination of an acoustic signal, or visual signal e.g. via an app/software, and/or via text or email message.

An intermedia device may be a computer, a PDA, a mobile phone, etc.

Which response measure is selected may, at least in part, be based on at least part of the obtained data from the hearing aid. That is, whether the response is to e.g. reinstall of software, update, arrange for human support, etc., may to some degree be selected based on one or more parameters within the obtained data.

Alternatively, or additionally, the response measure may be selected, at least in part, based on one or more similarities of the obtained data or user-specific data to the same type of data from one or more other hearing aid users. Specifically, if the one or more other hearing aid users belong to those who did not return their hearing aid. For example, a matching of similar hearing loss profiles of the hearing aid user to one or more other users could lead to selecting a response measure, wherein one or more pre-sets/programs on the hearing aid are updated to settings, which were used by the one or more other hearing aid users.

The data processing system determining the prediction score may have access to a cloud-based user profile database, wherein user-specific data such as the hearing loss profile is available. Another example could be a comparison based on location information, i.e. input from GPS information, accelerometers or a specific meeting room information from a calendar, which could result in selection of a response measure, wherein the pre-sets/programs of acoustic environment classes, i.e. the different types of sound environment known by the hearing aid, are updated to settings that were used by others in the same location.

The method steps of obtaining data, determining a prediction score and executing a response measure may be wholly automated actions, i.e. executed without human intervention. Alternatively, one or more steps may involve human intervention. In the case where the method is wholly automated, one or more steps may be optimized by human intervention such as e.g. changing all or part of the input for a machine learning model used in determining the prediction score.

In a second aspect is provided a system comprising a hearing aid, wherein the system is configured to perform the method according to the first aspect.

Additional features and advantages will be made apparent from the following detailed description with reference to the accompanying drawings.

BRIEF DESCRIPTION OF THE DRAWINGS

In the following, exemplary embodiments are described in more detail with reference to the appended drawings, wherein.

DETAILED DESCRIPTION

Figure 1:
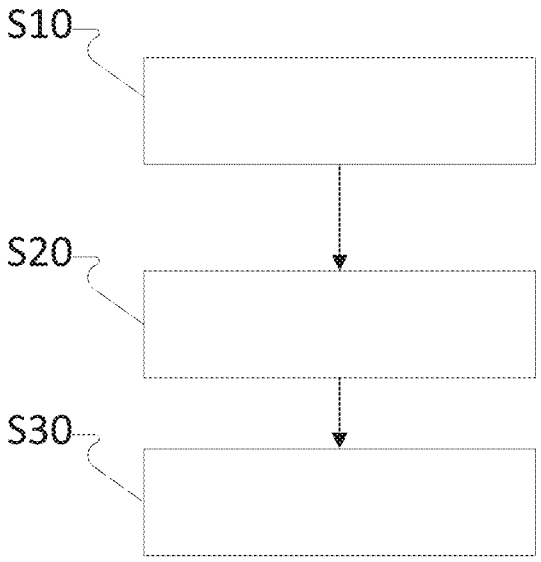
FIG. 1 is a flow diagram in accordance with exemplary embodiments.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

FIG. 1 shows a flow diagram in accordance with exemplary embodiments of the method of improving usability of and satisfaction with a hearing aid.

Modern hearing aids are sophisticated electronic devices, which can record a variety of data such as when, how and where the hearing aid is used, as well as any sensor data from on-board sensors. The "when" may include, but is not limited to, date, time of day, time since last reboot, time since first activation by user, use-time, etc. The "how" may include, but is not limited to, whether the hearing aid is on or off, whether pre-sets/programs are used or changed, whether the hearing aid is turned on or turned off, whether specific parts of the hearing loss compensation software are active, such as sound environment compensation, e.g. focus on a single talker or conversation in a noisy environment (cocktail party effect), etc. The "where" may include, but is not limited to, location, based on for example input from GPS information, accelerometers or a specific meeting room information from a calendar, but also which type of sound environment the user is in. Sensor data may include, but is not limited to, temperature, pulse, and oxidation saturation. Data obtained from a hearing aid can be used to analyse the user and the user's actions, and thereby provide a way for improving the usability of and satisfaction with the hearing aid.

For example, if using the sound environment as a parameter, one will in general see the effect of dissatisfaction in the way people navigate sound environments, e.g. which environments they linger in and which they try to avoid. This could, for example, mean: increased time in quiet environments, decreased time in noisy environments, and/or decreased time in speech-and-noise environments.

In FIG. 1, data is obtained from a hearing aid belonging to a user in step S10. If the data is to be analysed on a data processing system outside the hearing aid, the data may be transmitted from the hearing aid to the data processing system via e.g. the internet or a wireless protocols such as Bluetooth, Wi-Fi, NFC, etc. The data processing system may also be comprised within the hearing aid and the data obtained via communication pathways within the hearing aid.

After obtaining data from the hearing aid, a determination is made of a prediction score in step S20 indicating the likelihood of the user being dissatisfied with the hearing aid, where the determination is made based, at least in part, on the obtained data. The prediction score is an indicator of whether it is likely that the user is satisfied or dissatisfied with their hearing aid and may be the result of a predictive model built from past data.

Likelihood of dissatisfaction, if predicted using past data, could be given by the likelihood of the customer returning their devices and the likelihood could be indicated by a number that is returned by a machine learning model. A machine learning model is trained on a training set from a data lake, i.e. a repository of data, or from a database and it creates an internal representation of those who return their hearing aids and those who do not based on predetermined interaction parameters. Patterns of user behaviour are compared by the model to its trained internal representation and assigned a likelihood based on how close that comparison is.

Using past data to build a predictive model, could, for example, be achieved by comparing data recorded for a period of time from the hearing aid of users, who returned their hearing aids to that from the hearing aid of users, who did not return their hearing aids. The differences and/or trends in the data recorded from a significant number of users can be used to build a model forming part of the determination of a prediction score.

A machine learning model is made specific to the task and its algorithm will learn and improve as new data is fed into it. As more data is added, the model becomes more refined. The model may use raw data, i.e. the data obtained directly from the hearing aid, or processed data. The data obtained from the hearing aid may be processed in a number of known ways such that it is not the raw data that is used to determine the prediction score, but processed data. For example, simple calculations, where data is added, subtracted, etc. may be performed on the raw data. As another example, raw data may be combined to obtain a new type of data, which is not obtained directly from the hearing aid, but produced using raw data.

Figure 2:
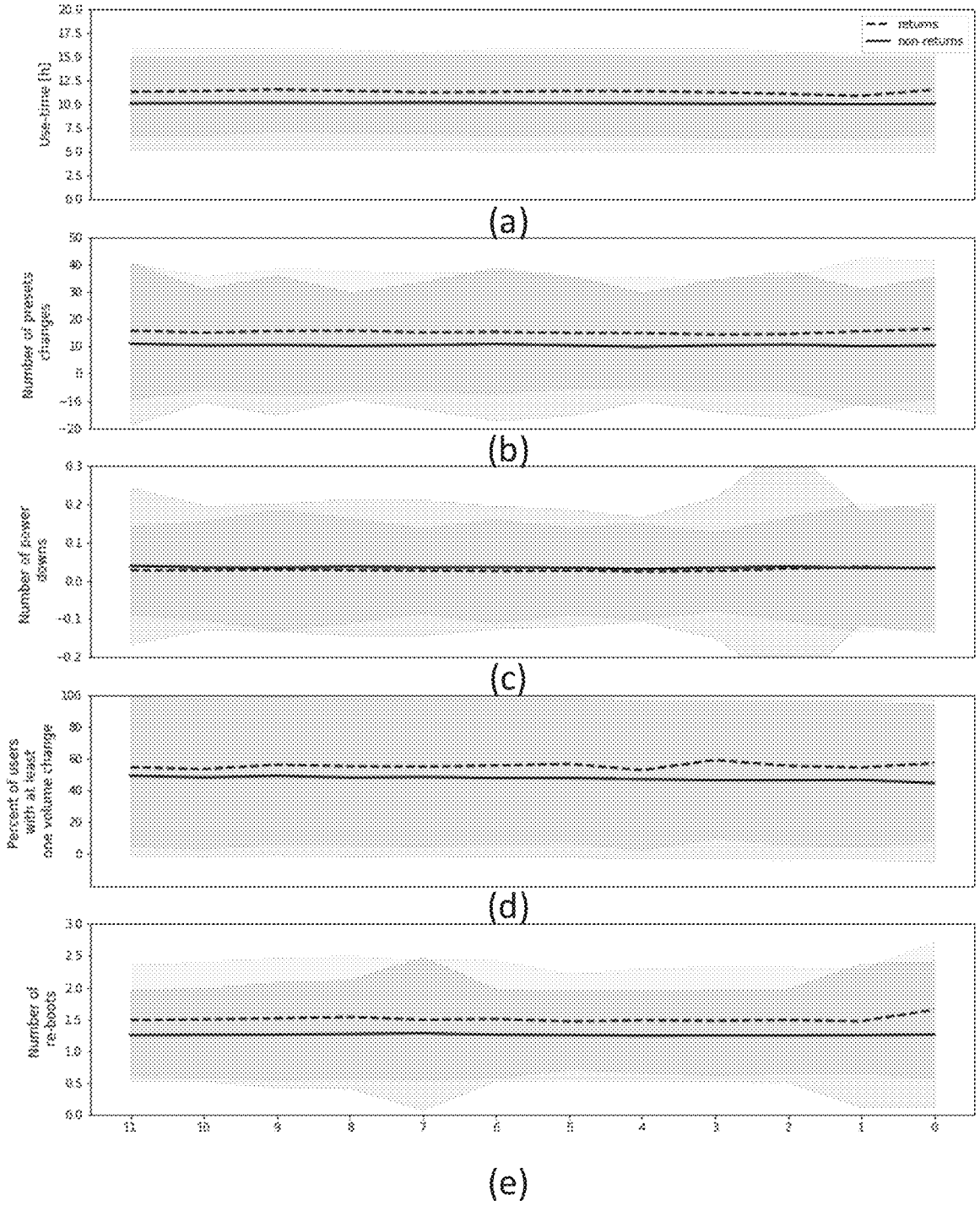
FIGS. 2-3 shows graphs of data obtained from hearing aids worn by users, and FIGS. 4-6 schematically illustrate a system comprising a hearing aid and configured to perform the method of improving usability of and satisfaction with a hearing aid in accordance with exemplary embodiments.
Figure 3:
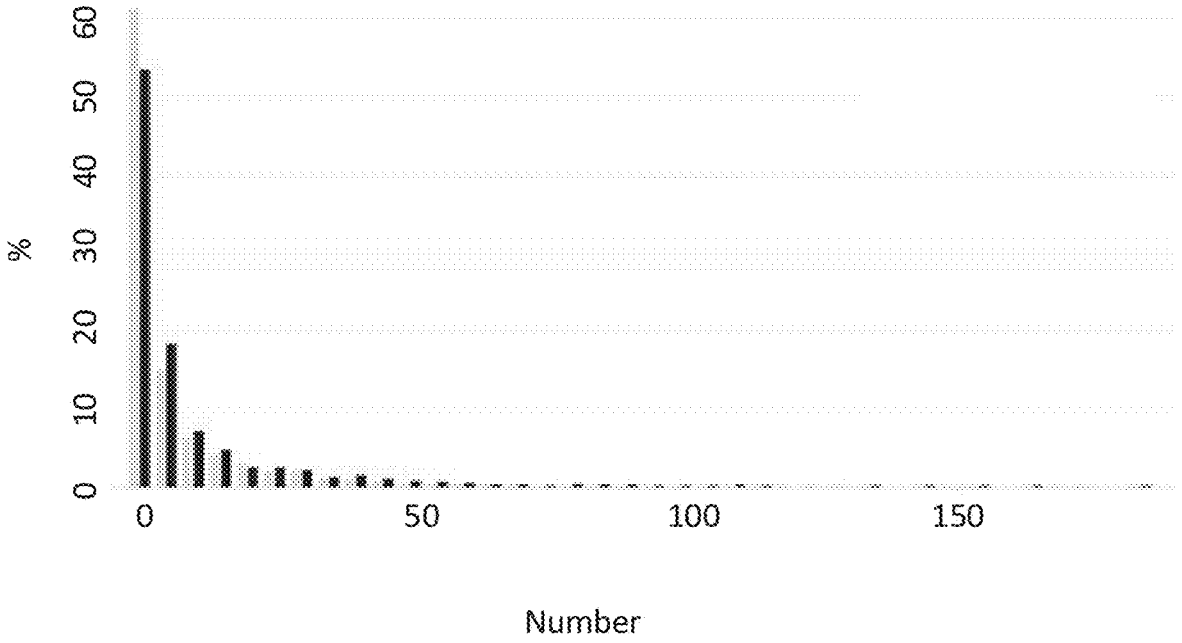

In FIGS. 2 and 3 are shown examples of data, which may be utilised in the determination of a prediction score (see further description of FIGS. 2 and 3 below). The five types of interaction parameters shown in FIG. 2 and the parameter shown in FIG. 3 appear to exhibit high confidence in predicting whether the user of the hearing aid returns the hearing aid or not. One example could be to monitor the sequence pattern of data obtained from the hearing aid, for example one or more of the type of data shown in FIG. 2*a-e*, and determine a prediction score based on the obtained data, where the prediction score then gives an indication of whether the user is likely to return the hearing aid and thereby an indication of user dissatisfaction.

Using the parameters use-time, number of volume changes, number of re-boots, number of pre-set changes and number of power downs, a machine learning model was achieved, which could in 77% of the cases correctly identify a user, who returned the hearing aid and in 70% of the cases correctly identify a user, who did not return their hearing aid. In that setup, mean sequence data up to the return from some weeks before the return were used, so the dynamic behaviour of the parameters was included.

The data obtained from the hearing aid may be obtained over a period of time, such as within a short-to-medium time frame, for example during a 90-day trial period. It may also be obtained long after the initial use of the hearing aid to continuously ensure satisfaction with the hearing aid. Even though the user may not be able to return the hearing aid after months or years of using it, the monitoring of data from the hearing aid and the therefrom determined prediction score can continue to provide an indication of user satisfaction. The obtained data may also be data collected within a very short time frame, such as a week, a day, or even hours, minutes or seconds, before the data is used in the determination of a prediction score.

The factors used in determining the prediction score may be a simple number such as use-time in hours, but it may also be a more complex interaction between the user and the hearing aid such as e.g. the change of the pre-set/program or activation of the volume control in a specific time pattern. Such complex interactions lend themselves to be analysed in a machine learning approach, where patterns in the data are discerned by an artificial intelligence algorithm. A machine learning model such as a neural network that is sensitive to sequence information, e.g. 1D ConvNets, can be trained to distinguish between users, who return their hearing aids to those who do not by learning the trends in the data parameters of those who return their hearing aids. Thus, the step of determining a prediction score may be at least partly performed using machine learning and/or artificial intelligence. For example, the step of determining a prediction score may be at least partly based on a model made using machine learning.

The prediction score may be a number and the value of the prediction score can be compared with a predetermined critical value, which separates the indication of satisfied from that of dissatisfied. For example, if the prediction score is e.g. higher than a predetermined value, the user may be categorised as dissatisfied. The prediction score may alternatively be expressed in a more complex manner than a single number, for example as several numbers, or as a letter and a number. Any labelling that allows for a decision to be made of whether the user is indicated as being satisfied or dissatisfied may be used.

If the prediction score indicates that the user is dissatisfied, a response measure is executed in step S30 of FIG. 1. The response measure will comprise adjusting the hearing aid functionality, or arranging for human support. Which response measure is chosen can be based, at least in part, on some or all of the data obtained from the hearing aid. For example, if the user changes pre-sets/programs often, this could indicate, possibly together with other data, that the user is dissatisfied with the programs and an update of one or more pre-sets/programs may be selected as response measure to try and improve the user experience. If the volume of the hearing aid is changed often, this may indicate, again possibly together with other data, that the hearing aid was not calibrated properly to the user's hearing loss and a suitable response measure may be notifying a hearing care professional such that a new calibration may be performed.

In this way the data collected on the user and the user's interaction with the hearing aid provides a data-driven approach to predict, whether a user is dissatisfied with their hearing aid, allowing for measures to be initiated to improve the usability and satisfaction with the hearing aid without having to directly contact the user to learn whether they are satisfied with their hearing aid.

In FIG. 2 is shown graphs of mean sequence data of five parameters 12 weeks prior to the last data logging before the hearing aid was returned compared with the same type of data from non-returns. The five parameters are (a) use-time [h], (b) number of pre-set/program changes, (c) number of power downs, (d) percentage of users with at least one volume change, and (e) number of re-boots, all as a function of weeks. The data is based on 4000 non-returns and 2000 returns. For all of the parameters in FIGS. 2*a-e*, a trend can be ascertained for the return cases versus the non-returns, thus providing a possibility of creating a predictive model.

In FIG. 3 is shown another example of data, which may be utilised in the determination of a prediction score. Shown is the percentage (%) of hearing aids versus the number of daily pre-set switches 8 weeks prior to the last data logging before the hearing aid was returned compared with the same type of data from non-returns. The data shown is based on 2300 returns and 11000 non-returns. In the graph the data from returns is shown in black and the data from non-returns is shown in grey. It shows that daily pre-set switches are higher for hearing aids that are returned compared to hearing aids that are not returned. Using these data, a machine learning model was achieved, which could in 72% of the cases correctly identify a user, who returned the hearing aid and in 96% of the cases correctly identify a user, who did not return their hearing aid.

Figure 4:
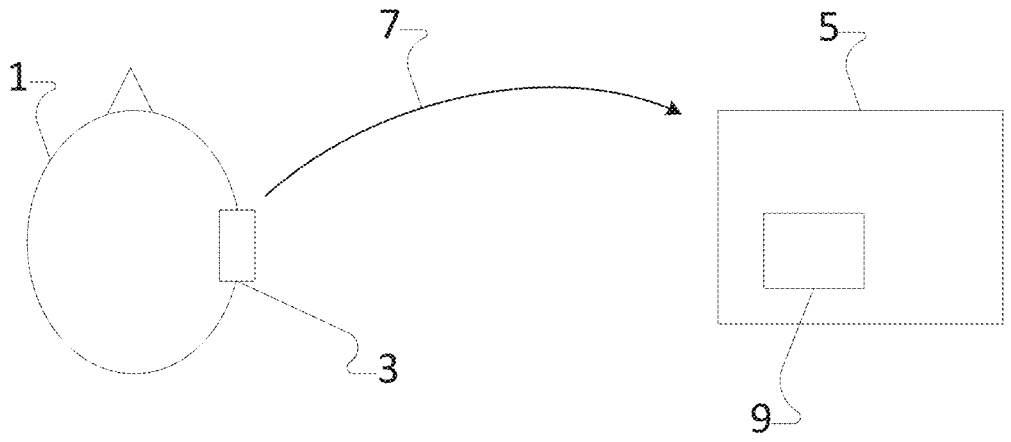

FIG. 4 schematically illustrates a system comprising a hearing aid and configured to perform the method of improving usability of and satisfaction with a hearing aid in accordance with exemplary embodiments. A user 1 is wearing a hearing aid 3, which collects data on the user and the user's behaviour such as e.g. use-time, number of pre-set/program changes, number of power downs, number of re-boots, number of battery charges, number of sound environment changes, pattern of sound environment changes, time spent in a type of sound environment, location, temperature, pulse, oxidation saturation. This data can be used in a number of ways and may be used by a data processing system 9, which is configured to obtain data from a hearing aid, determine a prediction score and execute a response measure.

In the embodiment shown in FIG. 4, the data processing system 9 is comprised in a remote server 5 and the hearing aid 3 is configured to communicate with the remote server 5 such that data transmission 7 between the hearing aid 3 and the remote server 5 is possible. The data transmission 7 between the hearing aid 3 and the remote server 5 may take place via software, for example an app, running on an external device such as e.g. a mobile phone.

The data processing system 9 obtains data via the data transmission 7 and determines a prediction score, which is at least in part based on the obtained data, but can also be based in part on user-specific data. The user-specific data could be, for example, type of the hearing aid, model of the hearing aid, age, gender, socioeconomics, hearing loss profile, user feedback rating provided, number of contacts to a hearing care professional, number of days since last contact with a hearing care professional, and use-time of a linked app. Such user-specific data could be obtained remotely, i.e. from outside the hearing aid, for example from one or more databases or external devices. In the embodiment shown in FIG. 4, user-specific data could be available on the remote server 5. Such user-specific data obtained remotely could link the information to the hearing aid ID and thereby link it to data obtained from the hearing aid 3.

Further, data from the hearing aid generated during test and/or manufacturing may also be used in determining the prediction score. The prediction score indicates the likelihood of the user being dissatisfied with the hearing aid and if the prediction indicates dissatisfaction, a response measure is executed.

The data transmission 7 may be performed regularly or sporadically. When using a predictive model based on past data, for example from comparing data recorded for a period of time from the hearing aid of users, who returned their hearing aids to those from the hearing aid of users, who did not return their hearing aids, to determine the prediction score, the predictive model may be continuously or periodically updated. The remote server 5 can be connected to a plurality of hearing aid users from which it receives data such that the predictive model can improve over time. The remote server 5 may comprise a machine learning algorithm, which analyses the data, for example by looking for trends in the data parameters of those users, who return their hearing aids, compared to those users, who do not. Alternatively, the remote server 5 may be connected to a system comprising a machine learning algorithm.

Figure 5:
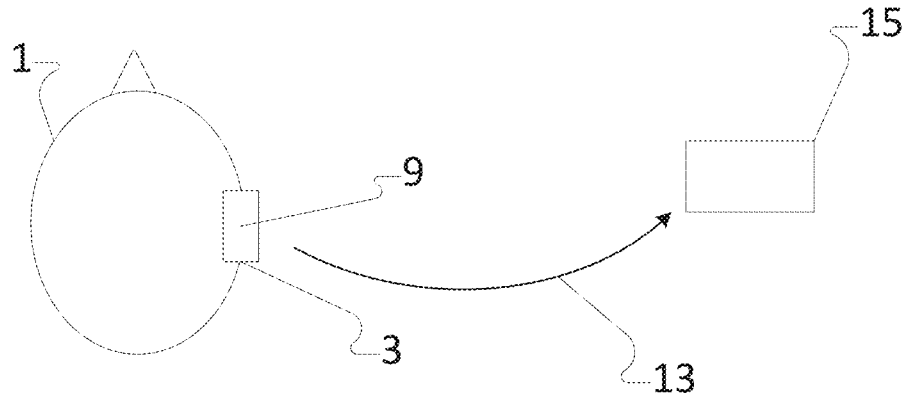

FIG. 5 schematically illustrates another system comprising a hearing aid and configured to perform the method of improving usability of and satisfaction with a hearing aid in accordance with other exemplary embodiments. As in FIGS. 4 and 6, a user 1 is wearing a hearing aid 3, which collects data on the user and the user's behaviour. In the embodiment shown in FIG. 5, a data processing system 9 is comprised in the hearing aid 3 and the data processing system 9 obtains data via communication pathways within the hearing aid 3. The data processing system 9 in the embodiment shown in FIG. 5 is configured to obtain data from the hearing aid 3, determine a prediction score, which is at least in part based on the obtained data, and execute a response measure. Executing the response measure may mean that the hearing aid arranges for a response measure to be implemented.

The prediction score may be a result of using a predictive model based on past data, for example based on a model obtained by comparing data recorded for a period of time from the hearing aid of users, who returned their hearing aids to those from the hearing aid of users, who did not return their hearing aids. The data processing system 9 within the hearing aid 3 may comprise software, which executes the predictive model. The predictive model may be updated regularly or periodically either by a software update or by a machine learning algorithm comprised in the data processing system 9.

To update the software or the machine learning algorithm, or to gather data from other hearing aid users, for example for use in creating a predictive model, the hearing aid 3 may have a means of wired or wireless communication 13 with an external system, for example wireless communication with a remote server 5 as shown in FIG. 4 or with an app running on an external device 15, where the external device may communicate with another system such as a remote server 5.

Figure 6:
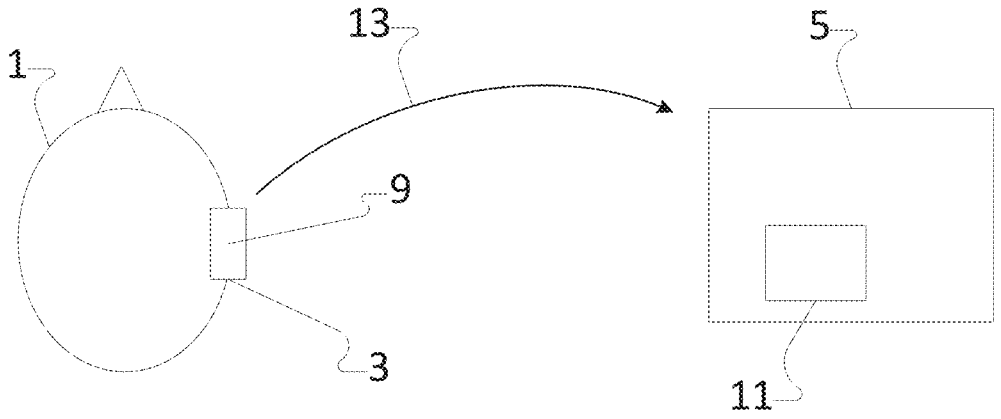

FIG. 6 schematically illustrates yet another system comprising a hearing aid and configured to perform the method of improving usability of and satisfaction with a hearing aid in accordance with other exemplary embodiments. As in FIGS. 4 and 5, a user 1 is wearing a hearing aid 3, which collects data on the user and the user's behaviour. In the embodiment shown in FIG. 6, as in FIG. 5, a data processing system 9 is comprised in the hearing aid 3 and the data processing system 9 obtains data via communication pathways within the hearing aid 3.

To acquire data from other hearing aid users, the hearing aid 3 has a means of wired or wireless communication 13 with an external system, for example wireless communication with a remote server 5. The remote server 5 has a database 11 comprising data from other hearing aid users, which the data processing system 9 may use in its determination of a prediction score.

The data from other hearing aid users may be data, which is or can be separated into data from users, who returned their hearing aids, and users, who did not return their hearing aids.

In all embodiments, a response measure is executed if the prediction score indicates that the user is dissatisfied and the response measure comprises adjusting the hearing aid functionality, or arranging for human support.

For example, a response measure, which adjusts the hearing aid functionality, could comprise one or more of the following adjustments of the hearing aid functionality: reinstalling software on the hearing aid, updating software on the hearing aid, changing one or more algorithm parameters, performing remote automatic fine-tuning of the hearing aid, and/or updating one or more pre-sets/programs on the hearing aid.

Alternatively, the data processing system 9 may be comprising partly within the hearing aid 3 and partly outside the hearing aid, for example within a remote server 5, such that one or more of the method steps are performed by circuitry within the hearing aid 3 and the rest on circuitry comprised outside the hearing aid.

If the data processing system 9, or part of it, is comprised in a remote server 5, it may execute one or more adjustments of the hearing aid functionality by pushing them to the hearing aid 3 or it may await a request. For example, the hearing aid 3 may periodically request updates and/or fine-tunings.

If the response measure is arranging for human support, it could comprise, for example, notifying the hearing aid user, notifying a hearing care professional, and/or notifying a customer service employee. Notifying the user 1 of the hearing aid 3 could be achieved, for example, via an app or via a communication means comprised in the hearing aid 3.

Although particular features have been shown and described, it will be understood that they are not intended to limit the claimed invention, and it will be made obvious to those skilled in the art that various changes and modifications may be made without departing from the scope of the claimed invention. The specification and drawings are, accordingly to be regarded in an illustrative rather than restrictive sense. The claimed invention is intended to cover all alternatives, modifications and equivalents.

LIST OF REFERENCES

1 User
3 Hearing aid
5 Remote server
7 Data transmission
9 Data processing system
11 Database
13 Wired or wireless communication
15 External device.

The invention claimed is:

1. A method of improving an usability of a hearing aid and/or a satisfaction with the hearing aid, the method comprising:

obtaining data from the hearing aid;

determining a prediction score based at least in part on the data, the prediction score indicating a likelihood of a user of the hearing aid being dissatisfied with the hearing aid, and executing a response measure if the prediction score indicates that the user of the hearing aid is dissatisfied, wherein the response measure comprises adjusting a functionality of the hearing aid, or arranging for human support, or a combination thereof.

2. The method according to claim 1, wherein the adjusting the functionality of the hearing aid comprises one or more of:

reinstalling software on the hearing aid, updating software on the hearing aid, changing one or more algorithm parameters, performing remote automatic fine-tuning of the hearing aid, and/or updating one or more pre-sets/programs on the hearing aid.

3. The method according to claim 1, wherein the arranging for the human support comprises one or more of: notifying the user of the hearing aid, notifying a hearing care professional, notifying a customer service employee, or any combination of the foregoing.

4. The method according to claim 1, further comprising selecting the response measure before the act of executing the response measure is performed, wherein the response measure is selected based at least in part on the data from the hearing aid.

5. The method according to claim 1, wherein the prediction score is at least partly based on data logged prior to hearing aid returns, data logged from non-returns, or a combination of the foregoing.

6. The method according to claim 1, wherein the prediction score is at least partly based on a comparison between data logged prior to hearing aid returns and data logged from non-returns.

7. The method according to claim 1, wherein the act of determining the prediction score is at least partly performed using machine learning and/or artificial intelligence.

8. The method according to claim 1, wherein the prediction score is determined using a model.

9. The method according to claim 8, wherein the model is built based on data logged prior to hearing aid returns, data logged from non-returns, or a combination of the foregoing.

10. The method according to claim 8, wherein the model comprises a neural network.

11. The method according to claim 1, wherein the act of obtaining the data, the act of determining the prediction score, and the act of executing the response measure are performed automatically.

12. The method according to claim 1, wherein the obtained data comprises: use-time, number of pre-set/program changes, number of power downs, number of re-boots, number of sound environment changes, pattern of sound environment changes, time spent in a type of sound environment, GPS location, temperature, pulse, oxidation saturation, or any combination of the foregoing.

13. The method according to claim 1, wherein the prediction score is also based at least in part on user data.

14. The method according to claim 13, wherein the user data comprises: a type of the hearing aid, a model of the hearing aid, age, gender, socioeconomics, hearing loss profile, user rating, number of contacts to a hearing care professional, number of days since last contact with the hearing care professional, use-time of an app, or any combination of the foregoing.

15. The method according to claim 13, further comprising obtaining the user data remotely.

16. The method according to claim 1, further comprising selecting the response measure based on a similarity between the data and other data for one or more other hearing aid users.

17. The method according to claim 16, further comprising determining the similarity between the data and the other data for the one or more other hearing aid users.

18. The method according to claim 1, further comprising selecting the response measure based on user data.

19. The method according to claim 18, wherein the user data comprises: a type of the hearing aid, a model of the hearing aid, age, gender, socioeconomics, hearing loss profile, user rating, number of contacts to a hearing care professional, number of days since last contact with the hearing care professional, use-time of an app, or any combination of the foregoing.

20. The method according to claim 18, wherein the response measure is selected based on a similarity between the user data and other user data for one or more other hearing aid users.

21. A system configured to perform the method according to claim 1.

* * * * *